US012624929B1

(12) United States Patent
Towers, V et al.

(10) Patent No.: US 12,624,929 B1
(45) Date of Patent: May 12, 2026

(54) SELF-DEFENSE DEVICES AND RELATED METHODS

(71) Applicant: SafeStrike Technologies LLC, Dover, DE (US)

(72) Inventors: Joseph A. Towers, V, Portland, TN (US); Jonathan J. Beagle, Vancouver, WA (US); Tina L. Towers, Mooresville, NC (US); Clint A. Walker, Grants Pass, OR (US)

(73) Assignee: SAFESTRIKE TECHNOLOGIES LLC, Dover, DE (US)

( * ) Notice: Subject to any disclaimer, the term of this patent is extended or adjusted under 35 U.S.C. 154(b) by 0 days.

(21) Appl. No.: 19/256,905

(22) Filed: Jul. 1, 2025

(51) Int. Cl.
*F41H 13/00* (2006.01)
*F41H 9/10* (2006.01)
*F41J 5/10* (2006.01)

(52) U.S. Cl.
CPC ..... *F41H 13/0012* (2013.01); *F41H 9/10* (2013.01); *F41H 13/0087* (2013.01); *F41J 5/10* (2013.01)

(58) Field of Classification Search
CPC ..... F41H 13/0012; F41H 13/0018; F41H 13/0087; F41H 9/10
See application file for complete search history.

(56) References Cited

U.S. PATENT DOCUMENTS 5,549,220 A * 8/1996 Whalen ..... F41H 13/00 222/113
5,625,525 A 4/1997 Coakley et al.
5,931,562 A 8/1999 Arato
6,052,051 A * 4/2000 Whalen ..... F41H 13/00 222/113
6,237,461 B1 * 5/2001 Poole ..... F41H 9/10 222/1
6,283,037 B1 9/2001 Sclafani
6,421,943 B1 * 7/2002 Caulfield ..... F41A 17/066 42/70.11
6,439,432 B1 * 8/2002 Park ..... H05C 1/00 222/113
6,823,621 B2 * 11/2004 Gotfried ..... F41A 17/066 42/70.01

(Continued)

*Primary Examiner* — Joshua E Freeman
(74) *Attorney, Agent, or Firm* — KOLITCH ROMANO DASCENZO GATES LLP

(57) ABSTRACT

Self-defense devices and related methods are disclosed herein. The self-defense devices are configured to be utilized by a user for protection from an aggressor and include at least one offensive component and at least one of a recording component and a communication component. In some examples, the self-defense devices include more than one offensive component and/or more than one offensive sub-component. The offensive component may be configured to be selectively actuated to incapacitate the aggressor. The recording component may be configured to selectively record a local environment that is proximate the self-defense device. The communication component may be configured to provide wireless communication between the user and a remote location. The methods include methods of utilizing a self-defense device for protection from an aggressor and include at least one of recording a local environment that is proximate the self-defense device, communicating with a remote location, and incapacitating the aggressor.

25 Claims, 5 Drawing Sheets

(56) References Cited

U.S. PATENT DOCUMENTS 7,152,990 B2 * 12/2006 Kukuk ..... F41B 15/04 222/113
7,524,076 B2 * 4/2009 Kukuk ..... F41H 13/0018 362/112
7,930,977 B2 4/2011 Klein
8,113,689 B2 2/2012 Mayo et al.
8,339,763 B2 12/2012 McNulty, Jr.
8,733,251 B1 * 5/2014 Abboud ..... F42B 5/285 361/232
9,267,768 B1 2/2016 Chang
10,054,305 B1 8/2018 Slepack
10,386,143 B2 * 8/2019 Jones ..... G08B 13/1436
11,561,058 B2 * 1/2023 Canty ..... H04N 23/66
2002/0108966 A1 * 8/2002 Park ..... F41H 9/10 222/113
2005/0243885 A1 11/2005 Nettleton et al.
2007/0028501 A1 * 2/2007 Fressola ..... F41H 13/0025 42/146
2007/0086190 A1 * 4/2007 Kukuk ..... F41C 23/10 362/253
2007/0194048 A1 * 8/2007 Teig ..... H04N 7/185 222/113
2009/0201621 A1 * 8/2009 Abatemarco ..... A45B 3/04 361/232
2010/0304874 A1 * 12/2010 Abatemarco ..... H05C 1/00 239/602
2012/0036990 A1 * 2/2012 Braun ..... F41C 33/001 361/232
2014/0252028 A1 * 9/2014 Lord ..... G08B 21/02 222/162
2019/0271527 A1 * 9/2019 Nangunoori ..... G08B 15/004
2019/0271528 A1 * 9/2019 Nangunoori ..... F41H 9/10
2020/0355456 A1 * 11/2020 Deng ..... H04N 23/66
2021/0185138 A1 * 6/2021 Gant ..... H04L 63/0861
2021/0364245 A1 * 11/2021 Burdine ..... F41A 17/063
2024/0078880 A1 * 3/2024 Topel ..... G06V 20/52
2024/0151484 A1 * 5/2024 Smith ..... F41A 17/066

* cited by examiner

SELF-DEFENSE DEVICES AND RELATED METHODS

FIELD OF THE DISCLOSURE

The present disclosure relates generally to self-defense devices and to methods of utilizing self-defense devices.

BACKGROUND OF THE DISCLOSURE

Conventional self-defense devices, such as firearms, historically have been utilized for protection from an aggressor. While such conventional self-defense devices may be effective in certain circumstances, they may be ineffective, or impermissible, in others. As an example, certain private citizens, organizations, and/or government agencies may be desirous of the capability for self-defense. However, conventional self-defense devices, such as firearms, may be an undesirable option and/or may not be permitted in certain facilities and/or at certain locations. As another example, some individuals may have a desire or need to possess a self-defense device yet are not willing or sufficiently trained to use a firearm. Thus, there exists a need for improved self-defense devices and related methods.

SUMMARY OF THE DISCLOSURE

Self-defense devices and related methods are disclosed herein. The self-defense devices are configured to be utilized by a user for protection from an aggressor and include at least one offensive component and at least one of a recording component and a communication component. The offensive component may be configured to be selectively actuated to incapacitate the aggressor. The self-defense devices may include more than one offensive component, the offensive component(s) may include more than one offensive subcomponent, and/or the offensive components and/or offensive subcomponents may be configured to deliver the same or different offensive outputs and/or may have the same or different effective ranges. The recording component may be configured to selectively record a local environment that is proximate the self-defense device. The communication component may be configured to provide wireless communication between the user and a remote location.

The methods include methods of utilizing a self-defense device for protection from an aggressor and include at least one of recording a local environment that is proximate the self-defense device, communicating with a remote location, and incapacitating the aggressor. The recording may be performed utilizing a recording component of the self-defense device. The communicating may be performed utilizing a communication component of the self-defense device. The incapacitating may be performed utilizing an offensive component of the self-defense device.

DETAILED DESCRIPTION AND BEST MODE OF THE DISCLOSURE

Figure 1:
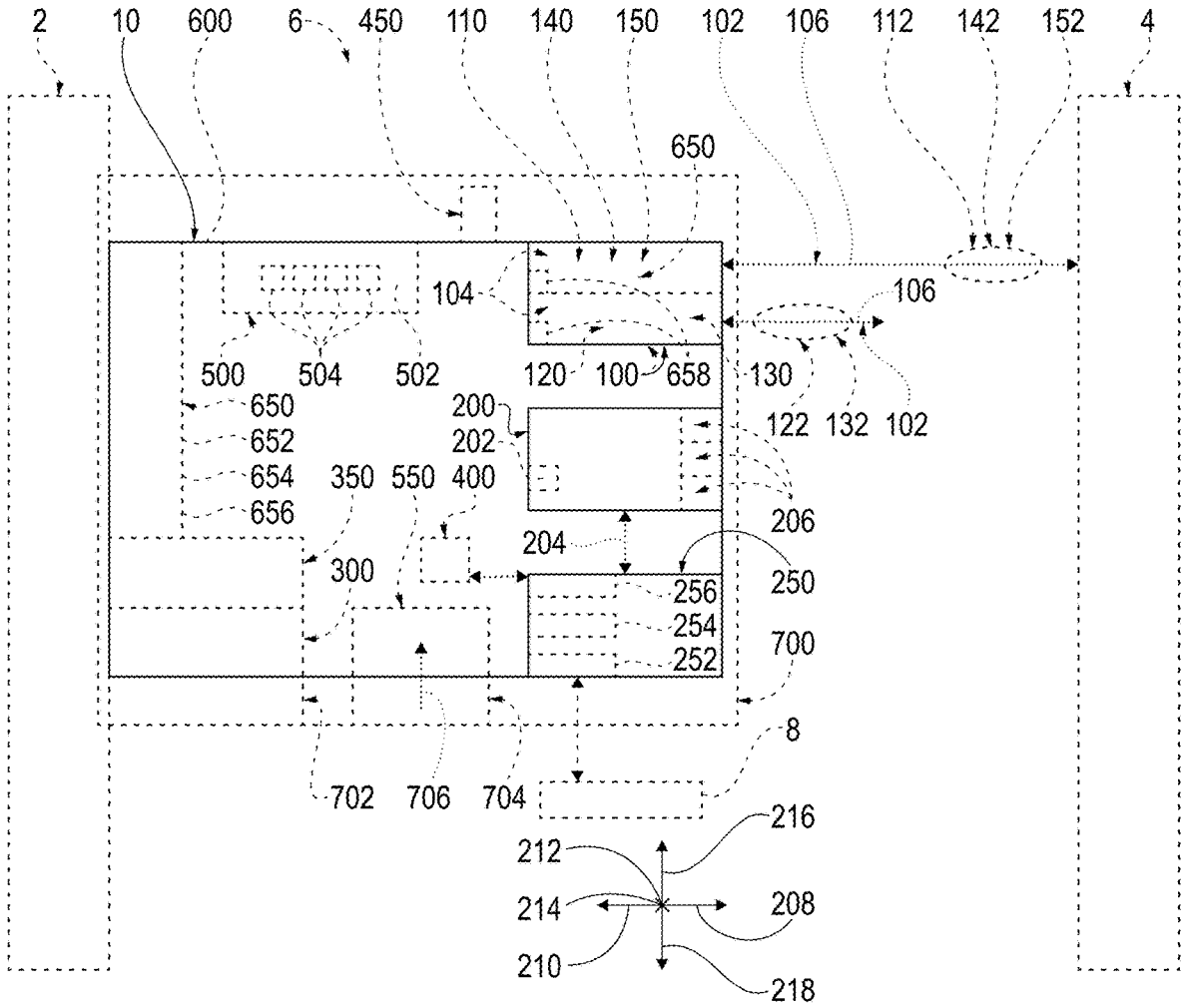
FIG. 1 is a schematic illustration of examples of self-defense devices according to the present disclosure.

FIGS. 1-5 provide examples of self-defense devices 10 and/or of methods 800, according to the present disclosure. Elements that serve a similar, or at least substantially similar, purpose are labeled with like numbers in each of FIGS. 1-5, and these elements may not be discussed in detail herein with reference to each of FIGS. 1-5. Similarly, all elements may not be labeled in each of FIGS. 1-5, but reference numerals associated therewith may be utilized herein for consistency. Elements, components, and/or features that are discussed herein with reference to one or more of FIGS. 1-5 may be included in and/or utilized with any of FIGS. 1-5 without departing from the scope of the present disclosure. In general, elements that are likely to be included in a particular embodiment are illustrated in solid lines, while elements that may be optional are illustrated in dashed lines. However, elements that are shown in solid lines may not be essential to all embodiments and, in some embodiments, may be omitted without departing from the scope of the present disclosure.

Figure 2:
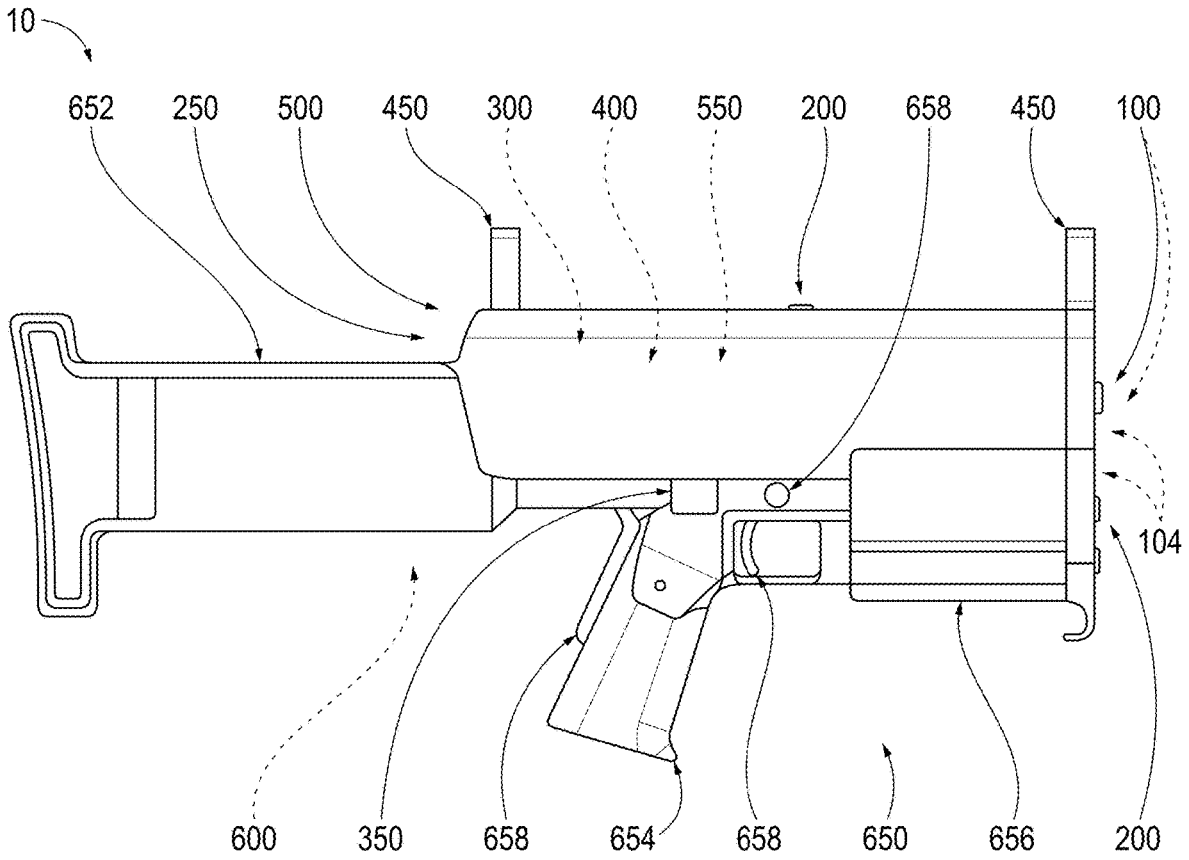
FIG. 2 is a less schematic side view illustrating examples of self-defense devices according to the present disclosure.
Figure 3:
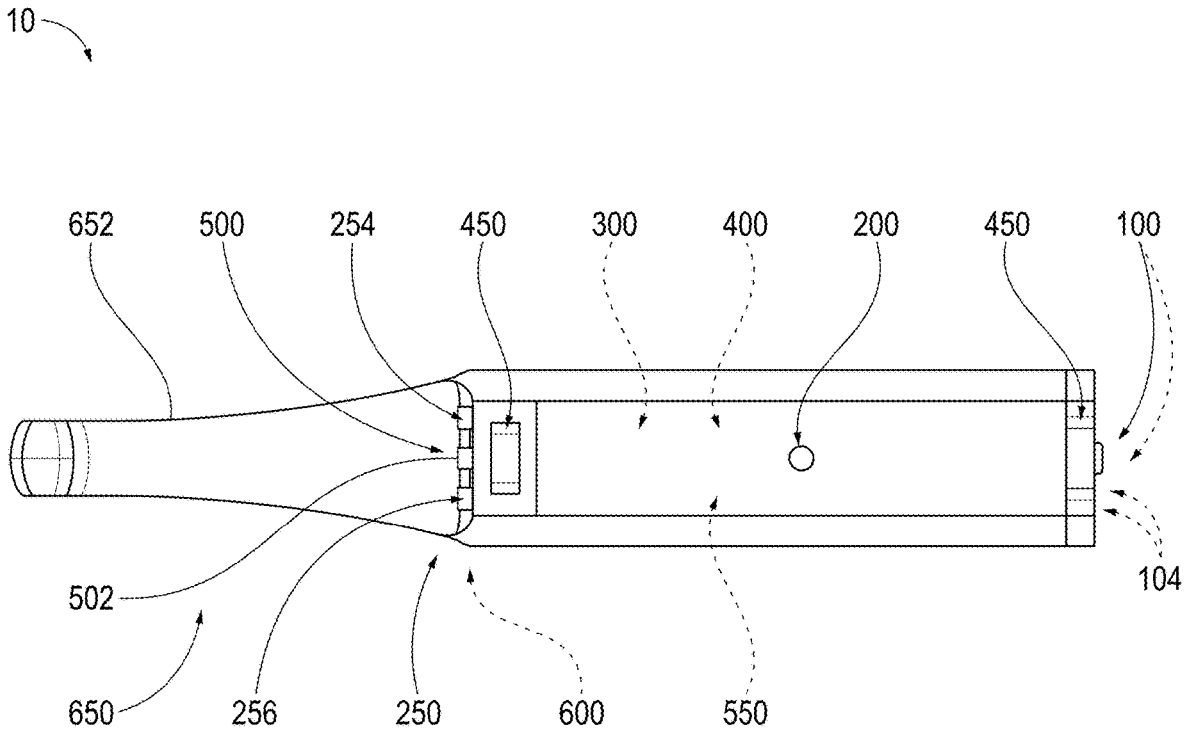
FIG. 3 is a top view of the self-defense devices of FIG. 2.
Figure 4:
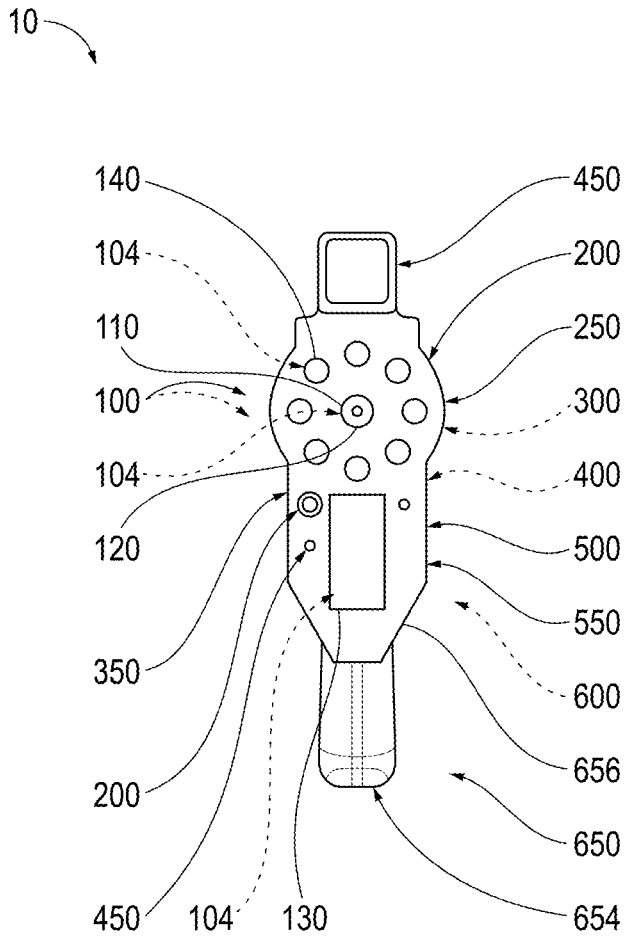
FIG. 4 is a front view of the self-defense devices of FIGS. 2-3.

FIG. 1 is a schematic illustration of examples of self-defense devices 10 according to the present disclosure. FIG. 2 is a less schematic side view illustrating examples of self-defense devices according to the present disclosure; FIG. 3 is a top view of the self-defense devices of FIG. 2; and FIG. 4 is a front view of the self-defense devices of FIGS. 2-3.

Self-defense devices 10 are configured to be utilized by a user 2 for protection from an aggressor 4. As collectively illustrated by FIGS. 1-4, and with specific reference to FIG. 1, self-defense devices 10 include at least one offensive component 100 and one or more of a recording component 200 and a communication component 250. The offensive component is configured to be selectively actuated to incapacitate the aggressor. The recording component is configured to selectively record a local environment 6 that is proximate the self-defense device. The communication component is configured to provide wireless communication between the user and a remote location 8 and/or between the local environment and a party at the remote location. As discussed in more detail herein, self-defense devices 10 may include more than one offensive component 100, both a recording component 200 and a communication component 250, more than one recording component 200, more than one communication component 250, and/or two or more offensive subcomponents for the one or more offensive components 100.

During operative use of self-defense devices 10, and as discussed in more detail herein, user 2 may utilize self-defense device 10 for protection when the user is threatened by the aggressor and/or when the aggressor is present, and self-defense device 10 may provide the user with a number of different and/or distinct functionalities, each of which may be beneficial to the user and/or may assist in protecting the user from the aggressor. As an example, and as discussed, user 2 may utilize, or actuate, the one or more offensive components 100 of self-defense device 10 to deter the aggressor, to disable the aggressor, to incapacitate the aggressor, and/or to encourage the aggressor to leave the local environment. Stated differently, offensive component 100 may permit the user to engage with the aggressor while the aggressor is distal (i.e., spaced more than an arm's-length distance from) the user, such as to prevent the aggressor from harming the user and/or another individual that is present within the local environment.

As another example, and as also discussed, recording component 200 may be utilized to selectively record the local environment that is proximate the self-defense device. Such recording may permit and/or facilitate documentation and/or archiving of video and/or audio of events that occur within the local environment while the user is utilizing the self-defense device.

As another example, and as also discussed, communication component 250 may be utilized, by the user, to communicate with the remote location. In a more specific example, communication component 250 may be utilized to provide audio and/or video from recording component 200 as real-time or near real-time information to law enforcement personnel that are present within the remote location. This audio and/or video may provide the law enforcement personnel with information regarding activities, physical characteristics, and/or identity of the aggressor, of the user, and/or within the local environment. Such real-time information may aid law enforcement personnel in responding to the local environment, locating the user and/or self-defense device, in protecting the user from the aggressor, and/or in preventing injury and/or damage to the user and/or to the local environment by the aggressor. In another more specific example, communication component 250 may be utilized, by the user, to communicate with the remote location. This may permit the user to provide the remote location with information regarding activities in the local environment and/or may permit individuals at the remote location, such as law enforcement personnel, to provide information and/or instructions to the user. As a further example, communication component 250 may be utilized to enable law enforcement or other parties at remote location 8 to communicate via the self-defense device with the user, the aggressor, and/or other individuals in the local environment proximate the self-defense device.

Offensive component 100 may include any suitable structure that may be adapted, configured, designed, and/or constructed to be selectively actuated, such as by the user, to incapacitate the aggressor. In some examples, offensive component 100 may have and/or define an effective range 102. As used herein, the phrase "effective range" refers to a maximum range, or a maximum distance, from the self-defense device and over which the offensive component can, or is configured to, incapacitate the aggressor. Stated differently, a non-zero effective range permits the user to engage with and/or to incapacitate the aggressor while the aggressor is within the effective range from the user, thereby protecting the user from direct, physical attack by the aggressor. Examples of effective range 102 include at least 1 meter (m), at least 2 m, at least 4 m, at least 6 m, at least 8 m, at least 10 m, at least 15 m, at least 20 m, at most 30 m, at most 25 m, at most 20 m, at most 18 m, at most 16 m, at most 14 m, at most 12 m, at most 10 m, at most 8 m, at most 6 m, at most 4 m, and/or at most 2 m.

As illustrated in dashed lines in FIG. 1, and in some examples, offensive component 100 may include a plurality of the same, different, and/or distinct offensive subcomponents 104. In such a configuration, each offensive subcomponent may have and/or exhibit a corresponding effective range 106, which may be the same as or different from the effective range of one or more other offensive subcomponents 104 and/or other offensive components 100 of self-defense device 10. In some such examples, a range ratio of a first effective range of a first offensive subcomponent of the plurality of offensive subcomponents is within a threshold range ratio multiple of a second effective range of a second offensive subcomponent of the plurality of offensive subcomponents. In some examples, a range ratio of a first effective range of a first offensive component is within a threshold range ratio multiple of a second effective range of a second offensive component 100 of a self-defense device 10. Examples of the threshold range ratio multiple include at least 1.2, at least 1.4, at least 1.6, at least 1.8, at least 2, at least 2.5, at least 3, at least 4, at least 5, at most 100, at most 90, at most 80, at most 70, at most 60, at most 50, at most 40, at most 35, at most 30, at most 25, at most 20, at most 15, at most 10, at most 5, at most 4, at most 3, and/or at most 2. Stated differently, the corresponding effective range of different offensive components and/or offensive subcomponents thereof may differ from one another. Such a configuration may permit and/or facilitate selection and/or utilization, such as by the user, of the offensive component and/or offensive subcomponent that is most well-suited for the distance, or the current distance, between the user and the aggressor.

An example of offensive component 100, or of an individual offensive subcomponent 104 of offensive component 100, is or includes a kinetic offensive component 110. Kinetic offensive components 110 may be configured to selectively deliver a kinetic blow, or a less lethal kinetic blow, to incapacitate the aggressor. As used herein, the phrase "less lethal" refers to a product that is designed to injure and/or to incapacitate a healthy adult human but not to be lethal and/or to kill the healthy adult human.

In specific examples, the kinetic offensive component may include and/or be a projectile offensive component configured to selectively deliver a less lethal projectile 112 to incapacitate the aggressor. The less lethal projectile may include and/or be a blunt force projectile, which may be configured to incapacitate the aggressor utilizing blunt force, which may be applied to the aggressor by the blunt force projectile. In such examples, the kinetic offensive component may be configured to fire, or to expel, the less lethal projectile to impact the aggressor with the less lethal projectile. Examples of the less lethal projectile include a rubber bullet, rubber shot, a bean bag, a capsule, a paint ball, a capsule that contains paint, a pepper ball, and/or a capsule that contains a chemical irritant.

Another example of offensive component 100, or of an individual offensive subcomponent 104 of the offensive component, is or includes a chemical irritant offensive component 120. Chemical irritant offensive component 120 may be configured to selectively deliver a chemical irritant 122 to incapacitate the aggressor. Examples of the chemical irritant include a pain-inducing chemical compound, pepper spray, tear gas, 2-chlorobenzalmalonitrile, chloroacetophenone, and/or oleoresin capsicum. The chemical irritant offensive component may be configured to selectively deliver the chemical irritant in any suitable manner. As an example, the chemical irritant offensive component may be configured to spray the chemical irritant. As another example, the chemical irritant offensive component may be configured to shoot, or to expel, a capsule, or a ball, that includes the chemical irritant.

Another example of offensive component 100, or of an individual offensive subcomponent 104 of the offensive component, is or includes a conducted energy offensive component 130. Conducted energy offensive component 130 is configured to selectively deliver an electric shock 132 to incapacitate the aggressor. Examples of the conducted energy offensive component include an electric energy source, a capacitor, a pair of electrodes, an electrically conductive projectile, an electrically conductive wire, a handheld conducted energy component, and/or a stun gun.

Commercially available examples of the conducted energy offensive component, or components thereof, include a TASER® and/or a PhaZZer®. Examples of electric shock include a high-voltage electric shock and/or an electric shock of at least 1,000 volts (V), at least 2,500 V, at least 5,000 V, at least 7,500 V, at least 10,000 V, at least 15,000 V, at least 20,000 V, at least 30,000 V, at least 40,000 V, at most 1,000,000 V, at most 500,000 V, at most 250,000 V, at most 100,000 V, at most 80,000 V, at most 60,000 V, at most 50,000 V, at most 40,000 V, at most 30,000 V, at most 20,000 V, at most 10,000 V, and/or at most 5,000 V.

Another example of offensive component 100, or of an individual offensive subcomponent 104 of the offensive component, is or includes an optical offensive component 140. Optical offensive component 140 may be configured to emit light 142 and selectively inhibit the aggressor's sight to incapacitate the aggressor. Examples of the optical offensive component include a light-emitting diode (LED), a light bulb, a laser light, a reflector, and/or a lens. Examples of the light include a beam of visible light and/or a strobe light. In some examples, the light may have a high-intensity and/or may have an intensity of at least 25,000 lumens (lm), at least 20,000 lm, at least 15,000 lm, at least 10,000 lm, at least 5,000 lm, at least 1,000 lm, at least 500 lm, at least 250 lm, or at least 100 lm.

In some examples, the optical offensive component may include and/or be a plurality of LEDs configured to selectively illuminate the aggressor to inhibit the aggressor's sight. Examples of the plurality of LEDs include at least 2, at least 3, at least 4, at least 5, at least 6, at least 8, at least 10, at most 20, at most 15, at most 10, at most 8, and/or at most 5 LEDs.

Another example of offensive component 100, or of an individual offensive subcomponent 104 of the offensive component, is or includes an acoustic offensive component 150. Acoustic offensive component 150 may be configured to selectively deliver acoustic energy 152 to incapacitate the aggressor. In specific examples, the acoustic energy may be configured to cause pain to eardrums of the aggressor and/or to disorient the aggressor. Examples of the acoustic offensive component include an acoustic energy emitter, an acoustic wave generator, a high-frequency acoustic energy emitter, a long-range acoustic energy emitter, a speaker, a piezoelectric component, and/or a vibrating component.

Offensive component 100 and/or any offensive subcomponents 104 thereof, may be configured to selectively deliver one or more emissions of the (sub)component's output without needing to be reloaded, recharged, and/or replaced. For example, offensive component 100 and/or offensive subcomponent 104 may be configured to selectively deliver, or emit, one or more kinetic projectile, chemical irritant spray or emission, electric shocks, optical emission, and/or audio emission without needing to be recharged, reloaded, or replaced. In some examples, offensive component 100 and/or offensive subcomponent 104 may be configured to selectively deliver, or emit, two or more of such outputs without needing to be recharged, reloaded, or replaced.

Recording component 200 may include any suitable structure that may be adapted, configured, designed, and/or constructed to record local environment 6. Recording component 200 may be configured to selectively record audio from the local environment and/or video of the local environment. Examples of recording component 200 include a microphone, a camera, a video camera, and/or a digital video camera.

In some examples, recording component 200 may include a plurality of video cameras 206. In such examples, each video camera of the plurality of video cameras may be configured to record a corresponding video in a corresponding recording direction. In some such examples, the corresponding recording direction of at least one video camera may differ from the corresponding recording direction of at least one other video camera. Such a configuration may permit and/or facilitate recording video of a larger fraction of the local environment that is visible from self-defense device 10. Examples of the corresponding recording direction of at least one video camera of the self-defense device include a forward, or at least substantially forward, direction 208; a rearward, or at least substantially rearward, direction 210; a leftward, or at least substantially leftward, direction 212, a rightward, or at least substantially rightward, direction 214, an upward, or at least substantially upward, direction 216, and/or a downward, or at least substantially downward direction 218. These directions may be defined with respect to a natural and/or a conventional orientation of the self-defense device when the user utilizes the self-defense device, such as with the offensive component's or components' discharge output, or discharge direction, pointed at the aggressor. As examples, and as illustrated, forward direction 208 may face away from the user and/or toward the aggressor, rearward direction 210 may face toward the user and/or away from the aggressor, leftward direction 212 may face toward the user's left, rightward direction 214 may face toward the user's right, upward direction 216 may face upward, and/or downward direction 218 may face downward.

Recording component 200 may include recording component memory 202. The recording component memory may be configured to store, or to electronically store, output 204 from the recording component, such as may be responsive to the recording component selectively recording the local environment. Stated differently, recording component memory 202 may be configured to store the audio and/or the video of the local environment that is recorded by the recording component. Such a configuration may permit and/or facilitate subsequent viewing and/or listening to the audio and/or video, long-term storage of the audio and/or video, and/or archiving of the audio and/or video.

Communication component 250 may include any suitable structure that may be adapted, configured, designed, and/or constructed to provide the wireless communication between the user and the remote location. Examples of communication component 250 include a wireless interface 252 that is configured to provide the wireless communication, such as a cellular interface and/or a Wi-Fi interface.

Remote location 8 may include and/or be any suitable location that may be remote from, distal from, and/or not coextensive with the local environment. Examples of the remote location include law enforcement, law enforcement personnel, a law enforcement office, a 911 dispatcher, an emergency dispatcher, and/or a law enforcement interface that is at and/or within the remote location. In some examples, remote location 8 may include and/or be a location of a monitoring service that may be hired, contracted, and/or engaged to monitor the wireless communication, to relay the wireless communication to law enforcement personnel, to report the wireless communication to law enforcement personnel, and/or to establish communication between the communication component and law enforcement personnel. In such examples, remote location 8 may include an individual, an entity, and/or an algorithm that evaluates the wireless communication prior to conveying the wireless communication to law enforcement personnel.

In some examples, and as discussed, communication component 250 may be configured to provide output 204 from recording component 200 to remote location 8. In some examples, the communication component may be configured to provide one-way or two-way communication between the user and the remote location and/or between the user and an individual who is at the remote location. With this in mind, and in some examples, the communication component may include a speaker 254 and/or a microphone 256. In some examples, the speaker and/or the microphone may be distinct from recording component 200. In some examples, the speaker and/or the microphone may form a portion of both the recording component and the communication component.

As discussed, individual components of self-defense device 10 may be activated and/or actuated based upon any suitable criteria, examples of which are discussed in more detail herein. As an example, communication component 250 may be configured to be activated to provide the wireless communication between the user and the remote location independent from actuation of the offensive component. Such a configuration may permit and/or facilitate communication between the user and the remote location even if the offensive component is not utilized and/or even if the user is not authorized to selectively actuate the offensive component, as is discussed in more detail herein.

It is within the scope of the present disclosure that individual components of self-defense device 10 may be activated and/or actuated based upon any suitable criteria, examples of which are discussed in more detail herein. As an example, recording component 200 and/or communication component 250 may be configured to be activated to selectively record the local environment independent from actuation of offensive component 100. Such a configuration may permit and/or facilitate recording of the local environment and/or communication with remote location 8 even if the offensive component is not utilized and/or even if the user is not authorized to selectively actuate the offensive component, as is discussed in more detail herein.

As illustrated in dashed lines in FIGS. 1-4, self-defense device 10 may include a user detection component 300. User detection component 300, when present, may be adapted, configured, designed, and/or constructed to detect that the user is utilizing, or attempting to utilize, the self-defense device and/or automatically to enable at least one function of the self-defense device responsive to detecting that the user is utilizing or attempting to utilize the self-defense device. For example, the detection component 300 may be configured to detect movement of the self-defense device, relative movement of a portion of the self-defense device with respect to the rest of the self-defense device, pressure applied to a region of the self-defense device, etc. The user detection component may include any suitable structure, examples of which include a force sensor, an accelerometer, an ultrasonic sensor, an infrared proximity sensor, an optical sensor, a user-actuated switch, a magnetic sensor, and/or a radio frequency identification sensor. When the user detection component includes the radio frequency identification sensor, the user may have on their person a corresponding radio frequency identification tag, such as to permit the radio frequency identification sensor to determine that the self-defense device is proximate the radio frequency identification tag.

The at least one function of the self-defense device that may be automatically enabled by the user detection component may include any suitable function of the self-defense device, such as a function of the self-defense device for which ready and/or automatic enablement may be beneficial and/or may not be dangerous to the user. An example of the at least one function of the self-defense device includes recording component 200. Such a configuration may permit and/or facilitate automatic recording of the local environment responsive to detection of the user by the user detection component. Another example of the at least one function of the self-defense device includes communication component 250. Such a configuration may permit and/or facilitate automatic communication with the remote location responsive to detection of the user by the user detection device. Yet another example of the at least one function of the self-defense device includes automatic supply of output 204 from recording component 200 to the remote location, such as via communication component 250, responsive to detection of the user by the user detection component. Such a configuration may permit the remote location and/or individuals at the remote location, such as law enforcement personnel, automatically to be notified that the user is utilizing the self-defense device and/or automatically to assess the remote location via the output from the recording component.

It is within the scope of the present disclosure that the at least one function of self-defense device 10 that the user detection component is configured to automatically enable may exclude, or may not include, offensive component 100. Stated differently, the self-defense device may not be configured to permit the user to actuate the offensive component solely upon detection that the user is utilizing the self-defense device. Instead, further authentication of the user may be required prior to the user being permitted to actuate the offensive component. Such a configuration may protect from and/or decrease a potential for inadvertent access to and/or actuation of the offensive component, such as by a user who is not authorized to actuate the offensive component and/or has not been trained to effectively actuate the offensive component. However, and as discussed, such a user still may have access to and/or may utilize recording component 200 and/or communication component 250. In some examples, the at least one function of self-defense device 10 that the user detection component is configured to automatically enable may include one or more offensive components 100 or subcomponents 104 while also excluding one or more other offensive components or offensive subcomponents. For example, in such self-defense devices 10, the self-defense device may be configured to automatically enable use of an optical and/or acoustic offensive component or subcomponent, while requiring further user authentication before enabling use of a kinetic, chemical, or electrical offensive component or offensive subcomponent.

As illustrated in dashed lines in FIGS. 1-4, self-defense device 10 may include a device user-authentication component 350. The device user-authentication component, when present, may be adapted, configured, designed, and/or constructed to authenticate the user. In such a configuration, self-defense device 10 may be configured to enable at least one restricted-access function of the self-defense device only responsive to authentication of the user by the device user-authentication component.

Device user-authentication component 350 may be configured to authenticate the user in any suitable manner and/or utilizing any suitable criteria. As an example, the device user-authentication component may be configured to confirm that the user is an authorized, a trained, and/or a predetermined user of the at least one restricted-access function of the self-defense device. Examples of the at least one restricted-access function of the self-defense device include the offensive component, some or all offensive components, and/or some or all offensive subcomponents. In such a configuration, the self-defense device may be configured to permit actuation of the offensive component and/or subcomponent only when the device user-authentication component has confirmed that the user is an authorized user of the otherwise restricted offensive component(s) and/or subcomponent(s).

It is within the scope of the present disclosure that device user-authentication component 350 may be distinct and/or separate from user detection component 300. Alternatively, it is also within the scope of the present disclosure that the device user-authentication component may form a portion of and/or may define the user detection component. Stated differently, the device user-authentication component may be configured to include any suitable structure, function, and/or feature that is discussed herein with reference to user detection component 300.

Device user-authentication component 350 may include any suitable structure that may be configured and/or utilized to authenticate the user. Examples of the device user-autentication component include a biometric sensor, fingerprint identification sensor, an electronic keypad, and/or a mechanical lock. In such examples, only users possessing the biometric feature(s), fingerprint, code, and/or key that the device user-authentication component is configured or preprogrammed to recognize will be authenticated by the device user-authentication component.

In some examples, device user-authentication component 350 may include one or more additional functions and/or features. As an example, and responsive to authentication of the user, the device user-authentication component may be configured to electronically store an activation record that identifies the user, transmit an identity of the user to the remote location, such as utilizing the communication component, and/or transmit a unique identifier that identifies the self-defense device to the remote location, such as utilizing the communication component. Such a configuration may permit an activation record for self-defense device 10 to be established and/or may facilitate identification of the self-defense device and/or the local environment by individuals, such as law enforcement personnel, that may be present at the remote location.

As another example, and responsive to authentication of the user, the device user-authentication component may be configured to record the local environment utilizing the recording component, transmit output from the recording component to the remote location utilizing the communication component, initiate wireless communication between the user and the remote location utilizing the communication component, and/or initiate one-way or two-way communication between the user and the remote location utilizing the communication component. Such a configuration may facilitate improved and/or automatic information transfer between the user and the remote location and/or may decrease a potential for user error in activating or deactivating one or more of these functions individually while confronting the aggressor.

As illustrated in dashed lines in FIGS. 1-4, self-defense devices 10 may include a tracking component 400. Tracking component 400, when present, may be adapted, configured, designed, and/or constructed to determine a location of self-defense device 10. Examples of the location of the self-defense device include locations that are based upon and/or indicative of GPS coordinates of the self-defense device, latitude and longitude of the self-defense device, and/or cartographical coordinates of the self-defense device. As an example, tracking component 400 may include and/or be a global positioning satellite tracking component configured to utilize global positioning satellites to determine the location of the self-defense device. Additional examples of tracking component 400 include a cellular tracking component, a Wi-Fi tracking component, and/or a Bluetooth tracking component configured to determine the location of the self-defense device based upon wireless triangulation and/or functionally similar methodologies.

In some examples, self-defense devices 10 may be configured to provide the location of the self-defense device to the remote location, such as via communication component 250. Such a configuration may permit individual(s), such as law enforcement personnel, at the remote location to know, establish, and/or determine the location of the self-defense device, and thus the location of the user and/or the aggressor, without requiring that the user know the location and/or communicate the location to the remote location. Additionally or alternatively, such a configuration may permit and/or facilitate automatic dispatch of law enforcement personnel to the remote location responsive to activation and/or selective actuation of one or more functions of the self-defense device.

As illustrated in dashed lines in FIG. 1 and in solid lines in FIGS. 2-4, self-defense device 10 may include a sighting component 450. Sighting component 450, when present, may be adapted, configured, designed, and/or constructed to facilitate aiming of the self-defense device and/or of offensive component 100 of the self-defense device at the aggressor. Examples of sighting component 450 include a sight, an iron sight, an optic, a red dot sight, a reflex sight, a scope, and/or a laser sight.

As illustrated in dashed lines in FIGS. 1-4, self-defense device 10 may include a status indicator 500. Status indicator 500, when present, may be adapted, configured, designed, and/or constructed to provide at least one status, or an indication of the at least one status, of the self-defense device to the user. Examples of status indicator 500 include a display screen 502, a lighted display, and/or a light-emitting diode 504. Examples of the at least one status of the self-defense device include a state of charge of the self-defense device, or of an electric power source 550 of the self-defense device, a status of active or established communication with the remote location via communication component 250, a recording status of recording component 200, a communication monitor status indicative of a presence of a monitoring individual, at the remote location, who is monitoring the wireless communication between the user and the remote location, an assistance call status that indicates when assistance, such as law enforcement personnel, is enroute to the location of the self-defense device, an assistance on-site status that indicates when the assistance is at the location of the self-defense device, a readiness of offensive component(s) 100 and/or offensive subcomponents(s) 104 to be selectively actuated to incapacitate the aggressor; a charge, capacity, or available users of the offensive component(s) and/or offensive subcomponents 104, and/or an authentication status of the user by device user-authentication component 350 of the self-defense device.

As illustrated in dashed lines in FIGS. 1-4, self-defense device 10 may include an electric power source 550. Electric power source 550, when present, may be adapted, configured, designed, and/or constructed to power, or to electrically power, at least one other component of the self-defense device. Examples of the at least one other component of the self-defense device include offensive component 100, recording component 200, communication component 250, user detection component 300, device user-authentication component 350, tracking component 400, sighting component 450, and/or status indicator 500. Examples of electric power source 550 include an electric charge storage device, a capacitor, and/or a battery.

As illustrated in dashed lines in FIG. 1 and in solid lines in FIGS. 2-4, self-defense device 10 may include at least one user interface component 650, such as may be adapted, configured, designed, and/or constructed to permit and/or facilitate user interaction with and/or actuation of the self-defense device. As a more specific example, self-defense device 10 may include and/or be a shoulder-fired self-defense device configured to be shouldered, by the user, at least when offensive component 100 is selectively actuated to incapacitate the aggressor. In such a configuration, user interface component 650 may include and/or be a stock 652, which may be configured to be shouldered by the user, as illustrated in dashed lines in FIG. 1 and in solid lines in FIGS. 2-3. As another more specific example, user interface component 650 may include and/or be a hand grip 654 configured to be gripped by the user, as illustrated in dashed lines in FIG. 1 and in solid lines in FIGS. 2 and 4. As yet another example, user interface component 650 may include and/or be a forend 656 configured to be supported by the user, as illustrated in dashed lines in FIG. 1 and in solid lines in FIGS. 2 and 4.

As another example, user interface component 650 may include and/or be an actuator 658 configured to be selectively actuated by the user to selectively actuate offensive component 100 and/or at least one other function of the self-defense device, as illustrated in dashed lines in FIG. 1 and in solid lines in FIG. 2. In some such examples, user interface component 650 may include a plurality of actuators 658. In such a configuration, a corresponding actuator of the plurality of actuators may be configured to be selectively actuated by the user to selectively actuate a corresponding function and/or component of the self-defense device. As examples, the corresponding actuator may be selectively actuated to selectively actuate offensive component 100, each offensive subcomponent 104, recording component 200, communication component 250, user detection component 300, tracking component 400, and/or sighting component 450. In a specific example, and as collectively illustrated by FIGS. 2-4, self-defense device 10 and/or user interface component 650 thereof may include corresponding actuators 658 to actuate a combination of kinetic offensive component 110 and chemical irritant offensive component 120 in the form of a pepper ball, conducted energy offensive component 130 in the form of a TASER®, optical offensive component 140 in the form of high-intensity light from LEDs, and/or sighting component 450 in the form of a laser sight.

It is within the scope of the present disclosure that self-defense device 10 may include and/or be an assembly of two or more of the components that are disclosed herein. Stated differently, any and/or all of the components disclosed herein, or included in a given self-defense device 10, may be operatively attached to one another to form a single device and/or structure that defines the self-defense device. In a specific example, at least offensive component 100, recording component 200, and communication component 250 may be operatively attached to one another to define the self-defense device. Such a configuration may permit and/or facilitate integration among the various components of the self-defense device, as is discussed herein. Additionally or alternatively, such a configuration may permit individuals at the remote location, such as law enforcement personnel, automatically to know capabilities of the user, via the self-defense device, responsive to communication being established between the self-defense device and the remote location via the communication component.

In some examples, self-defense device 10 may include and/or be a modular self-defense device, which may include a plurality of component modules, or individual component modules, configured to be selectively attached to one another to define the self-defense device. Such a configuration may permit and/or facilitate customization of the self-defense device to a specific user and/or a specific local environment. Examples of the plurality of component modules include one or more of offensive component 100, at least one individual offensive subcomponent 104 of the plurality of offensive subcomponents, recording component 200, communication component 250, user detection component 300, device user-authentication component 350, tracking component 400, sighting component 450, status indicator 500, electric power source 550, and/or user interface component 650. In some such examples, self-defense device 10 may include a component chassis 600, as illustrated in dashed lines in FIGS. 1-4. In such a configuration, at least a subset of the plurality of component modules, or even each component module of the plurality of component modules, may be configured to be operatively attached to the component chassis. This operative attachment may be direct and/or indirect, and it also is within the scope of the present disclosure that one or more of the plurality of component modules may be defined by component chassis 600. As examples, stock 652, hand grip 654, and/or forend 656 may be defined by the component chassis.

As illustrated in dashed lines in FIG. 1, self-defense device 10 may include a storage enclosure 700. Storage enclosure 700, when present, may be adapted, configured, designed, constructed, and/or sized to store, or to securely store, the self-defense device. Such a configuration may be utilized to protect the self-defense device, to provide a predetermined storage location for the self-defense device, and/or to decrease a potential for unauthorized access to and/or use of the self-defense device.

In some examples, the storage enclosure may include and/or be a surface-mount storage enclosure, such as may be configured to be mounted on and/or attached to a wall. Such a configuration may permit and/or facilitate retrofitting of existing local environments to include the self-defense device.

In some examples, storage enclosure 700 may include an enclosure user-authentication component 702. Enclosure user-authentication component 702 may be adapted, configured, designed and/or constructed to permit access to the self-defense device, such as via opening the storage enclosure and/or permitting the self-defense device to be removed from the enclosure, responsive to authentication of the user by the enclosure user-authentication component. Examples of the enclosure user-authentication component are disclosed herein with reference to device user-authentication component 350. In some examples, the enclosure user-authentication component may be separate and/or distinct from the device user-authentication component. Stated differently, and in such examples, enclosure user-authentication component 702 may be utilized to restrict physical access to a remainder of self-defense device 10, and device user-authentication component 350 may be utilized to restrict access to and/or actuation of the at least one restricted-access function of the self-defense device. Such a configuration may be utilized to permit physical access to the self-defense device by a first group of individuals and enablement of the at least one restricted-access function of the self-defense device by a second group of individuals that differs from the first group of individuals.

Alternatively, and in some examples, enclosure user-authentication component 702 and device user-authentication component 350 may be the same, or a single, user authentication component. Such a configuration may permit and/or facilitate both physical access to the self-defense device and enablement of the at least one restricted-access function of the self-defense device via a single authentication of the user.

In some examples, self-defense device 10 may be configured to enable, or automatically to enable, at least one function of the self-defense device responsive to authentication of the user by the enclosure user-authentication component. Examples of the at least one function of the self-defense device include recording component 200 and/or communication component 250. In a specific example, the self-defense device may be configured automatically to enable one-way or two-way communication with the remote location, automatically to provide the location of the self-defense device to the remote location, and/or automatically to provide output from the recording component to the remote location responsive to authentication of the user by the enclosure user-authentication component.

As illustrated in dashed lines in FIG. 1, storage enclosure 700 may include a charging device 704. Charging device 704, when present, may be configured to charge electric power source 550, such as by providing an electric current 706 to the electric power source.

Figure 5:
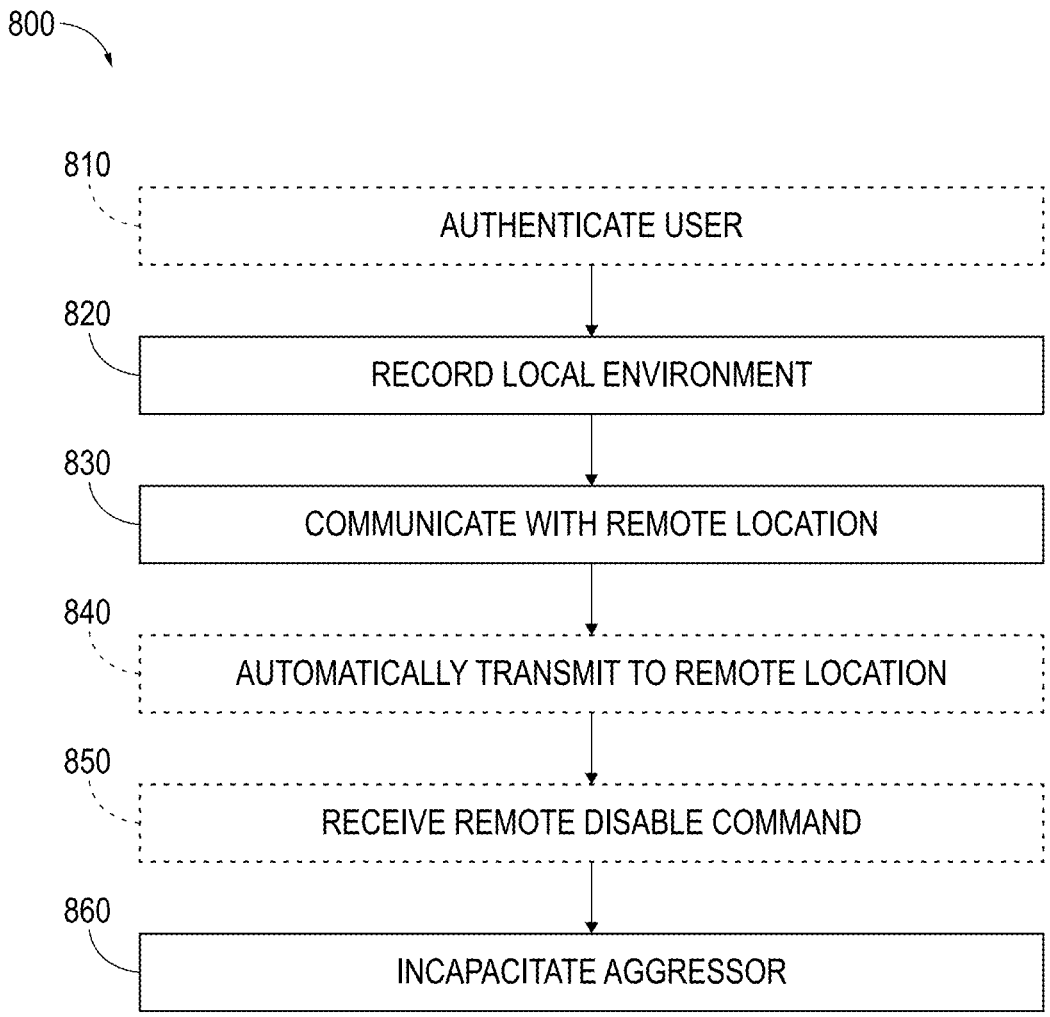
FIG. 5 is a flowchart illustrating examples of methods of utilizing self-defense devices, according to the present disclosure.

FIG. 5 is a flowchart illustrating examples of methods 800 of utilizing self-defense devices, according to the present disclosure. Methods 800 may be utilized to protect a user from an aggressor. Examples of the self-defense devices are disclosed herein with reference to self-defense devices 10 of FIGS. 1-4, and it is within the scope of the present disclosure that methods 800 may include and/or utilize any suitable structure, function, and/or feature disclosed herein with reference to self-defense devices 10. Methods 800 may include authenticating the user at 810 and include recording a local environment at 820 and communicating with a remote location at 830. Methods 800 also may include automatically transmitting to the remote location at 840 and/or receiving a remote disable command at 850 and include incapacitating the aggressor at 860.

Authenticating the user at 810 may include authenticating the user with, via, and/or utilizing a user-authentication component of the self-defense device. Examples of the user-authentication device are disclosed herein with reference to device user-authentication component 350 and/or enclosure user-authentication component 702. The authenticating at 810 may be performed in any suitable manner and/or for any suitable purpose. As an example, the authenticating at 810 may be performed prior to the incapacitating at 860. As another example, the authenticating at 810 may be required prior to the incapacitating at 860. As a more specific example, the authenticating at 810 may be performed to permit actuation of the offensive component to perform the incapacitating at 860. Such a configuration may decrease a potential for inadvertent and/or unauthorized actuation of the offensive component.

The authenticating at 810 may be performed with any suitable timing and/or sequence during methods 800. As examples, the authenticating at 810 may be performed prior to the recording at 820, prior to the communicating at 830, prior to the automatically transmitting at 840, and/or prior to the receiving at 850. As another example, the authenticating at 810 may be performed to permit and/or to enable the recording at 820, the communicating at 830, the automatically transmitting at 840, the receiving at 850, and/or the incapacitating at 860.

Recording the local environment at 820 may include recording a local environment that is proximate, that surrounds, and/or that is visible from the self-defense device. This may be accomplished in any suitable manner. As an example, the self-defense device may include a recording component, and the recording at 820 may be performed with, via, and/or utilizing the recording component. Examples of the recording component are disclosed herein with reference to recording component 200.

In some examples, methods 800 may include automatically performing the recording at 820 based upon suitable criteria and/or conditions. As specific examples, methods 800 may include automatically performing the recording at 820 responsive to detection that the user is utilizing the self-defense device, responsive to authentication of the user by the self-defense device, and/or responsive to the authenticating at 810. Such a configuration may permit and/or facilitate automatically establishing a recorded record of events that occur within the local environment. Additionally or alternatively, such a configuration may permit and/or facilitate automatic transmission of output from the recording at 820 and/or from the recording component that performs the recording at 820 to the remote location, such as via the communicating at 830, as is discussed in more detail herein.

It is within the scope of the present disclosure that the recording at 820 further may include storing the output from the recording at 820. This may include storing audio and/or video of the local environment. As an example, the storing may include storing with and/or on recording component memory of the recording component.

Communicating with the remote location at 830 may include communicating with the remote location with, via, and/or utilizing a communication component of the self-defense device. Examples of the communication component are disclosed herein with reference to communication component 250. Examples of the remote location are disclosed herein with reference to remote location 8.

In some examples, the communicating at 830 may include automatically communicating with the remote location. As more specific examples, methods 800 may include automatically performing the communicating at 830 responsive to detection that the user is utilizing the self-defense device, responsive to authentication of the user by the self-defense device, and/or responsive to the authenticating at 810.

In some examples, the communicating at 830 may include providing a location of the self-defense device to the remote location. As an example, the self-defense device may include a tracking component configured to determine the location of the self-defense device, and the providing the location may include providing the location with, via, and/or utilizing the tracking component. Examples of the tracking component are disclosed herein with reference to tracking component 400.

In some examples, the communicating at 830 may include communicating in real-time with the remote location. This may include establishing one-way or two-way communication between the self-defense device and the remote location. In some examples, the communicating at 830 may include providing one or more notifications to the remote location. As examples, the communicating at 830 may include notifying the remote location responsive to the self-defense device detecting that the user is utilizing the self-defense device, responsive to authentication of the user by the self-defense device, responsive to the recording at 820, and/or responsive to the incapacitating at 860.

Automatically transmitting to the remote location at 840 may include automatically transmitting a recording of the local environment to the remote location. This may be accomplished in any suitable manner. As examples, the automatically transmitting at 840 may be performed responsive to the authenticating at 810 and/or responsive to the recording at 820. Such a configuration may provide situational awareness regarding the local environment to individuals, such as law enforcement personnel, who are at the remote location.

Receiving the remote disable command at 850 may include receiving any suitable remote disable command with the self-defense device in any suitable manner. As examples, the receiving at 850 may include receiving the remote disable command from the remote location and/or receiving the remote disable command via the communication component. When methods 800 include the receiving at 850, the methods further may include disabling at least one disabled function of the self-defense device responsive to the receiving at 850. Examples of the at least one disabled function include a status indicator of the self-defense device, the offensive component, and/or an individual offensive subcomponent. Examples of the status indicator are disclosed herein with reference to status indicator 500.

Such a configuration may decrease a potential for unauthorized operation of the self-defense device. As an example, and based upon the recording at 820 and/or the communicating at 830, the individual at the remote location may have situational awareness regarding events within the local environment. Should the aggressor obtain access to the self-defense device, it may be desirable to decrease a potential for the aggressor to harm the user utilizing the self-defense device, such as via disabling the offensive component. Additionally or alternatively, and as discussed in more detail herein, the status indicator may include and/or convey information regarding any response force that may be enroute to, proximate, and/or at the local environment. As such, it may be desirable to decrease a potential for the aggressor to obtain this information, such as via disabling the status indicator if and/or when the aggressor obtains access to the self-defense device.

Incapacitating the aggressor at 860 may include incapacitating the aggressor with, via, and/or utilizing an offensive component of the self-defense device. Examples of the offensive component are disclosed herein with reference to offensive component 100. The incapacitating at 860 may be performed in any suitable manner. As an example, the incapacitating at 860 may include actuating the offensive component, or an actuator of the offensive component, to incapacitate the aggressor. Examples of the actuator are disclosed herein with reference to actuator 658.

As discussed in more detail herein, self-defense device 10 may include more than one offensive component and/or a/the offensive component may include a plurality of offensive subcomponents, examples of which are disclosed herein with reference to offensive subcomponents 104. As also discussed, each offensive subcomponent of the plurality of offensive subcomponents may be configured to exhibit a corresponding range. In such a configuration, the incapacitating at 860 further may include selecting a given offensive subcomponent of the plurality of offensive subcomponents based, at least in part, on a distance from the self-defense device to the aggressor. It follows that the incapacitating the aggressor at 860 may include repeating the utilization of the offensive component, or the same or a different offensive subcomponent thereof, and/or utilizing a second offensive component, or offensive component thereof. As an example, the repeating may include repeating the selecting to select a different offensive subcomponent of the plurality of offensive subcomponents based, at least in part, on a change in the distance from the self-defense device to the aggressor.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of self-defense devices and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A self-defense device configured to be utilized by a user for protection from an aggressor, the self-defense device comprising:

an offensive component configured to be selectively actuated to incapacitate the aggressor; and at least one, and optionally both, of:

(i) a recording component configured to selectively record a local environment that is proximate the self-defense device; and (ii) a communication component configured to provide wireless communication between the user and a remote location.

A2. The self-defense device of paragraph A1, wherein the offensive component is configured to exhibit an effective range of at least one of:

(i) at least 1 meter (m), at least 2 m, at least 4 m, at least 6 m, at least 8 m, at least 10 m, at least 15 m, or at least 20 m; and (ii) at most 30 m, at most 25 m, at most 20 m, at most 18 m, at most 16 m, at most 14 m, at most 12 m, at most 10 m, at most 8 m, at most 6 m, at most 4 m, or at most 2 m.

A3. The self-defense device of any of paragraphs A1-A2, wherein the offensive component includes a plurality of offensive subcomponents.

A3.1. The self-defense device of paragraph A3, wherein each offensive subcomponent of the plurality of offensive subcomponents is configured to exhibit a corresponding effective range.

A3.2. The self-defense device of paragraph A3.1, wherein a range ratio of a first effective range of a first offensive subcomponent of the plurality of offensive subcomponents is within a threshold range ratio multiple of a second effective range of a second offensive subcomponent of the plurality of offensive subcomponents.

A4. The self-defense device of paragraph A3.2, wherein the threshold range ratio multiple is at least one of:

(i) at least 1.2, at least 1.4, at least 1.6, at least 1.8, at least 2, at least 2.5, at least 3, at least 4, or at least 5; and (ii) at most 100, at most 90, at most 80, at most 70, at most 60, at most 50, at most 40, at most 35, at most 30, at most 25, at most 20, at most 15, at most 10, at most 5, at most 4, at most 3, or at most 2.

A5. The self-defense device of any of paragraphs A1-A4, wherein the offensive component, or an individual offensive subcomponent of a/the plurality of offensive subcomponents, includes, or is, a kinetic offensive component configured to selectively deliver a less lethal kinetic blow to incapacitate the aggressor, optionally wherein the kinetic offensive component includes, or is, a projectile offensive component configured to selectively deliver a less lethal projectile to incapacitate the aggressor.

A6. The self-defense device of paragraph A5, wherein the less lethal projectile is a blunt force projectile configured to incapacitate the aggressor utilizing a blunt force applied to the aggressor by the blunt force projectile.

A7. The self-defense device of any of paragraphs A5-A6, wherein the kinetic offensive component is configured to fire the less lethal projectile to impact the aggressor with the less lethal projectile.

A8. The self-defense device of any of paragraphs A5-A7, wherein the less lethal projectile includes at least one of:

(i) a rubber bullet;

(ii) rubber shot;

(iii) a bean bag;

(iv) a paint ball; and (v) a pepper ball.

A9. The self-defense device of any of paragraphs A1-A8, wherein the offensive component, or an individual offensive subcomponent of a/the plurality of offensive subcomponents, includes, or is, a chemical irritant offensive component configured to selectively deliver a chemical irritant to incapacitate the aggressor.

A10. The self-defense device of paragraph A9, wherein the chemical irritant includes at least one of:

(i) a pain-inducing chemical compound;

(ii) pepper spray;

(iii) tear gas;

(iv) 2-chlorobenzalmalononitrile;

(v) chloroacetophenone; and (vi) oleoresin capsicum.

A11. The self-defense device of any of paragraphs A9-A10, wherein the chemical irritant offensive component is configured to at least one of:

(i) spray the chemical irritant; and (ii) expel a capsule that includes the chemical irritant.

A12. The self-defense device of any of paragraphs A1-A11, wherein the offensive component, or an individual offensive subcomponent of a/the plurality of offensive subcomponents, includes, or is, a conducted energy offensive component configured to selectively deliver an electric shock to incapacitate the aggressor.

A13. The self-defense device of paragraph A12, wherein the electric shock is a high-voltage electric shock with a voltage of at least one of:

(i) at least 1,000 volts (V), at least 2,500 V, at least 5,000 V, at least 7,500 V, at least 10,000 V, at least 15,000 V, at least 20,000 V, at least 30,000 V, or at least 40,000 V; and (ii) at most 1,000,000 V, at most 500,000 V, at most 250,000 V, at most 100,000 V, at most 80,000 V, at most 60,000 V, at most 50,000 V, at most 40,000 V, at most 30,000 V, at most 20,000 V, at most 10,000 V, or at most 5,000 V.

A14. The self-defense device of any of paragraphs A12-A13, wherein the conducted energy offensive component includes at least one of:

(i) an electric energy source;

(ii) a capacitor;

(iii) a pair of electrodes;

(iv) an electrically conductive projectile;

(v) an electrically conductive wire;

(vi) a handheld conducted energy component; and (vii) a stun gun.

A15. The self-defense device of any of paragraphs A1-A14, wherein the offensive component, or an individual offensive subcomponent of a/the plurality of offensive subcomponents, includes an optical offensive component configured to emit light and selectively inhibit the aggressor's sight to incapacitate the aggressor, optionally wherein the optical offensive component is configured to emit at least 25,000 lumens (lm), at least 20,000 lm, at least 15,000 lm, at least 10,000 lm, at least 5,000 lm, at least 1,000 lm, at least 500 lm, at least 250 lm, or at least 100 lm.

A16. The self-defense device of paragraph A15, wherein the optical offensive component is configured to emit at least one of:

(i) a beam of visible light; and (ii) a light strobe.

A17. The self-defense device of any of paragraphs A15-A16, wherein the optical offensive component includes a plurality of light-emitting diodes configured to selectively illuminate the aggressor to inhibit the aggressor's sight.

A18. The self-defense device of any of paragraphs A1-A17, wherein the offensive component, or an individual offensive subcomponent of a/the plurality of offensive subcomponents, includes an acoustic energy offensive component configured to selectively deliver acoustic energy to incapacitate the aggressor.

A19. The self-defense device of paragraph A18, wherein the acoustic energy offensive component is configured to cause pain to eardrums of the aggressor.

A20. The self-defense device of any of paragraphs A18-A19, wherein the acoustic energy offensive component includes at least one of:

(i) an acoustic energy emitter;

(ii) a high-frequency acoustic energy emitter;

(iii) a long-range acoustic component, and (iv) a speaker.

A21. The self-defense device of any of paragraphs A1-A20, wherein the recording component is configured to selectively record at least one, and optionally both, of:

(i) audio from the local environment; and (ii) video of the local environment.

A22. The self-defense device of any of paragraphs A1-A21, wherein the recording component includes a microphone.

A23. The self-defense device of any of paragraphs A1-A22, wherein the recording component includes at least one video camera.

A23.1. The self-defense device of any of paragraphs A1-A23, wherein the recording component includes a plurality of video cameras, wherein each video camera of the plurality of video cameras is configured to record a corresponding video in a corresponding recording direction.

A24. The self-defense device of paragraph A23.1, wherein the corresponding recording direction of at least one video camera of the plurality of video cameras differs from the corresponding recording direction of at least one other video camera of the plurality of video cameras.

A25. The self-defense device of any of paragraphs A23-A24, wherein at least one of:

(i) the corresponding recording direction of at least one video camera is in a forward, or at least substantially forward, direction;

(ii) the corresponding recording direction of at least one video camera is in a rearward, or at least substantially rearward, direction;

(iii) the corresponding recording direction of at least one video camera is in a leftward, or at least substantially leftward, direction;

(iv) the corresponding recording direction of at least one video camera is in a rightward, or at least substantially rightward, direction;

(v) the corresponding recording direction of at least one video camera is in an upward, or at least substantially upward, direction; and (vi) the corresponding recording direction of at least one video camera is in a downward, or at least substantially downward, direction.

A26. The self-defense device of any of paragraphs A1-A25, wherein the recording component includes recording component memory configured to electronically store output from the recording component responsive to the recording component selectively recording the local environment.

A27. The self-defense device of any of paragraphs A1-A26, wherein the recording component is configured to be activated to selectively record the local environment independent from actuation of the offensive component, or an individual offensive subcomponent of a/the plurality of offensive subcomponents.

A28. The self-defense device of any of paragraphs A1-A27, wherein the communication component includes a wireless interface configured to provide the wireless communication, optionally wherein the wireless interface includes at least one, and optionally both, of a cellular interface and a Wi-Fi interface.

A29. The self-defense device of any of paragraphs A1-A28, wherein the communication component is configured to provide the wireless communication between the user and at least one of:

(i) law enforcement;
(ii) a law enforcement office;
(iii) a 911 dispatcher; and
(iv) a law enforcement interface at the remote location.

A30. The self-defense device of any of paragraphs A1-A29, wherein the remote location includes at least one of:

(i) law enforcement;
(ii) a/the law enforcement office;
(iii) a/the 911 dispatcher; and
(iv) a/the law enforcement interface at the remote location.

A31. The self-defense device of any of paragraphs A1-A30, wherein the communication component is configured to provide an output from the recording component to the remote location.

A32. The self-defense device of any of paragraphs A1-A31, wherein the communication component is configured to provide one-way or two-way communication between the user and the remote location.

A33. The self-defense device of any of paragraphs A1-A32, wherein the communication component includes at least one of:

(i) a speaker; and
(ii) a microphone.

A34. The self-defense device of any of paragraphs A1-A33, wherein the communication component is configured to be activated to provide the wireless communication between the user and the remote location independent from actuation of the offensive component, or an individual offensive subcomponent of a/the plurality of offensive subcomponents.

A35. The self-defense device of any of paragraphs A1-A34, wherein the self-defense device includes a user detection component configured to detect that the user is utilizing the self-defense device and automatically to enable at least one function of the self-defense device responsive to detecting that the user is utilizing the self-defense device.

A36. The self-defense device of paragraph A35, wherein the user detection component includes at least one of a force sensor, an accelerometer, an ultrasonic sensor, an infrared proximity sensor, an optical sensor, a user-actuated switch, a magnetic sensor, and a radio frequency identification sensor.

A37. The self-defense device of any of paragraphs A35-A36, wherein the at least one function of the self-defense device includes the recording component.

A38. The self-defense device of any of paragraphs A35-A37, wherein the at least one function of the self-defense device includes the communication component.

A39. The self-defense device of any of paragraphs A35-A38, wherein, responsive to detection that the user is utilizing the self-defense device, the self-defense device is configured automatically to provide an/the output from the recording component to the remote location.

A40. The self-defense device of any of paragraphs A35-A39, wherein the at least one function of the self-defense device excludes the offensive component, or at least one excluded individual offensive subcomponent of a/the plurality of offensive subcomponents.

A40.1. The self-defense device of paragraph A40, wherein the at least one excluded individual offensive subcomponent includes at least one of:

(i) a/the kinetic offensive component;
(ii) a/the chemical irritant offensive component;
(iii) a/the conducted energy offensive component;
(iv) an/the optical offensive component; and
(v) an/the acoustic offensive component.

A40.2. The self-defense device of any of paragraphs A40-A41.1, wherein the at least one function of the self-defense device includes at least one included individual offensive subcomponent of a/the plurality of offensive subcomponents.

A40.3. The self-defense device of paragraph A40.2, wherein the at least one included individual offensive subcomponent includes at least one of:

(i) a/the kinetic offensive component;
(ii) a/the chemical irritant offensive component;
(iii) a/the conducted energy offensive component;
(iv) an/the optical offensive component; and
(v) an/the acoustic offensive component.

A41. The self-defense device of any of paragraphs A1-A40.3, wherein the self-defense device includes a device user-authentication component configured to authenticate the user, and further wherein the self-defense device is configured to enable at least one restricted-access function of the self-defense device responsive to authentication of the user by the device user-authentication component.

A42. The self-defense device of paragraph A41, wherein the device user-authentication component is configured to confirm that the user is an authorized user of the at least one restricted-access function of the self-defense device.

A43. The self-defense device of any of paragraphs A41-A42, wherein the at least one restricted-access function of the self-defense device includes, or is, the offensive component, or an individual offensive subcomponent of the offensive component, and further wherein the self-defense device is configured to permit actuation of the offensive component, or of the individual offensive subcomponent, only when the device user-authentication component has confirmed that the user is an authorized user of the offensive component, or of the individual offensive subcomponent.

A44. The self-defense device of any of paragraphs A41-A43, wherein the device user-authentication component is distinct from a/the user detection component.

A45. The self-defense device of any of paragraphs A41-A44, wherein the device user-authentication component forms a portion of, or defines, a/the user detection component, optionally wherein the device user-authentication component is configured to include any suitable structure, function, and/or feature of the user detection component.

A46. The self-defense device of any of paragraphs A41-A45, wherein the device user-authentication component includes at least one of:

(i) a biometric sensor;
(ii) a fingerprint identification sensor;
(iii) an electronic keypad; and
(iv) a mechanical lock.

A47. The self-defense device of any of paragraphs A41-A46, wherein, responsive to authentication of the user, the device user-authentication component is configured to at least one of:

(i) electronically store an activation record that identifies the user;

(ii) transmit an identity of the user to the remote location, optionally utilizing the communication component; and (iii) transmit a unique identifier that identifies the self-defense device to the remote location, optionally utilizing the communication component.

A48. The self-defense device of any of paragraphs A41-A47, wherein, responsive to authentication of the user, the device user-authentication component is configured to at least one of:

(i) record the local environment utilizing the recording component;

(ii) transmit output from the recording component to the remote location utilizing the communication component;

(iii) initiate wireless communication between the user and the remote location utilizing the communication component; and (iv) initiate two-way communication between the user and the remote location utilizing the communication component.

A49. The self-defense device of any of paragraphs A1-A48, wherein the self-defense component further includes a tracking component configured to determine a location of the self-defense device, optionally wherein the location of the self-defense device includes, is based upon, or is indicative of GPS coordinates of the self-defense device, and further optionally wherein the tracking component includes a global positioning satellite tracking component.

A50. The self-defense device of paragraph A49, wherein the communication component is configured to provide the location of the self-defense device to the remote location.

A51. The self-defense device of any of paragraphs A1-A49, wherein the self-defense device further includes a sighting component configured to facilitate aiming the offensive component, or of an individual offensive subcomponent of a/the plurality of offensive subcomponents, at the aggressor.

A52. The self-defense device of paragraph A51, wherein the sighting component includes at least one of a sight, an iron sight, a red dot sight, a reflex sight, a scope, and a laser sight.

A53. The self-defense device of any of paragraphs A1-A52, wherein the self-defense device includes a status indicator configured to provide at least one status of the self-defense device to the user, optionally wherein the status indicator includes at least one of a display screen, a lighted display, and a light-emitting diode.

A54. The self-defense device of paragraph A53, wherein the at least one status includes at least one of:

(i) a state of charge of the self-defense device;

(ii) a status of communication with the remote location via the communication component;

(iii) a recording status of the recording component;

(iv) a communication monitor status indicative of a presence of a monitoring individual, at the remote location, who is monitoring the wireless communication between the user and the remote location;

(v) an assistance call status that indicates when assistance is enroute to a/the location of the self-defense device;

(vi) an assistance on-site status that indicates when the assistance is at the location of the self-defense device;

(vii) a readiness of the offensive component, or of an individual offensive subcomponent of a/the plurality of offensive subcomponents, to be selectively actuated to incapacitate the aggressor; and (viii) an authentication status of the user by a/the device user-authentication component of the self-defense device.

A55. The self-defense device of any of paragraphs A1-A54, wherein the self-defense device further includes an electric power source configured to electrically power at least one other component of the self-defense device, optionally wherein the electric power source includes a battery.

A56. The self-defense device of any of paragraphs A1-A55, wherein the self-defense device is a shoulder-fired self-defense device configured to be shouldered, by the user, when the offensive component, or an individual offensive subcomponent of a/the plurality of offensive subcomponents, is selectively actuated to incapacitate the aggressor.

A57. The self-defense device of any of paragraphs A1-A56, wherein the self-defense device includes a stock configured to be shouldered by the user when the offensive component, or an individual offensive subcomponent of a/the plurality of offensive subcomponents, is selectively actuated to incapacitate the aggressor.

A58. The self-defense device of any of paragraphs A1-A57, wherein the self-defense device includes a forend configured to be supported by the user when the offensive component, or an individual offensive subcomponent of a/the plurality of offensive subcomponents, is selectively actuated to incapacitate the aggressor.

A59. The self-defense device of any of paragraphs A1-A58, wherein the self-defense device includes an actuator configured to be selectively actuated by the user to selectively actuate the offensive component, or an individual offensive subcomponent of a/the plurality of offensive subcomponents, to incapacitate the aggressor.

A60. The self-defense device of any of paragraphs A1-A59, wherein the offensive component, the recording component, and the communication component, and optionally all components of the self-defense device, are operatively attached to one another to define the self-defense device.

A61. The self-defense device of any of paragraphs A1-A60, wherein the self-defense device is a modular self-defense component that includes a plurality of component modules configured to be selectively attached to one another to define the self-defense device, optionally wherein the plurality of component modules includes at least one of:

(i) the offensive component, or at least one individual offensive subcomponent of a/the plurality of offensive subcomponents;

(ii) a/the kinetic offensive component;

(iii) a/the chemical irritant offensive component;

(iv) a/the conducted energy offensive component;

(v) an/the optical offensive component;

(vi) an/the acoustic offensive component;

(vii) the recording component;

(viii) the communication component;

(ix) an/the user detection component;

(x) an/the device user-authentication component;

(xi) a/the tracking component;

(xii) a/the sighting component;

(xiii) a/the status indicator; and (xiv) a/the electric power source.

A62. The self-defense device of paragraph A61, wherein the self-defense device further includes a component chassis configured to be operatively attached to, at least indirectly operatively attached to, or directly and operatively attached to, at least a subset, or all, of the plurality of component modules.

A63. The self-defense device of any of paragraphs A1-A62, wherein the self-defense device further includes a storage enclosure configured to securely store the self-defense device.

A64. The self-defense device of paragraph A63, wherein the storage enclosure is a surface-mount storage enclosure configured to be mounted to a wall.

A65. The self-defense device of any of paragraphs A63-A64, wherein the storage enclosure includes an enclosure user-authentication component configured to authenticate the user, and further wherein the storage enclosure is configured to permit access to the self-defense device responsive to authentication of the user.

A66. The self-defense device of paragraph A65, wherein the enclosure user-authentication component is distinct from the device user-authentication component.

A67. The self-defense device of paragraph A65, wherein the enclosure user-authentication component is the device user-authentication component.

A68. The self-defense device of any of paragraphs A65-A67, wherein the self-defense device is configured automatically to enable at least one function of the self-defense device responsive to authentication of the user by the enclosure user-authentication component.

A69. The self-defense device of paragraph A68, wherein the at least one function of the self-defense device includes the recording component.

A70. The self-defense device of any of paragraphs A68-A69, wherein the at least one function of the self-defense device includes the communication component.

A71. The self-defense device of any of paragraphs A63-A70, wherein the storage enclosure further includes a charging device configured to charge a/the electric power source of the self-defense device.

B1. A method of utilizing a self-defense device for protection from an aggressor, the method comprising at least one, optionally at least two, and further optionally all three of:

recording, utilizing a recording component of the self-defense device, a local environment that is proximate the self-defense device;

communicating, utilizing a communication component of the self-defense device, with a remote location; and incapacitating, utilizing an offensive component of the self-defense device, the aggressor.

B2. The method of paragraph B1, wherein the recording includes automatically recording responsive to at least one of:

(i) detection that the user is utilizing the self-defense device; and (ii) authentication of the user by the self-defense device.

B3. The method of any of paragraphs B1-B2, wherein the recording includes storing at least one, and optionally both, of:

(i) audio from the local environment; and (ii) video of the local environment.

B4. The method of any of paragraphs B1-B3, wherein, responsive to the recording, the method further includes automatically transmitting a recording of the local environment to the remote location.

B5. The method of any of paragraphs B1-B4, wherein the communicating includes automatically communicating responsive to at least one of:

(i) detection that the user is utilizing the self-defense device; and (ii) authentication of the user by the self-defense device.

B6. The method of any of paragraphs B1-B5, wherein the remote location includes, or is, at least one of:

(i) law enforcement;

(ii) a law enforcement office;

(iii) a 911 dispatcher; and (iv) a law enforcement interface.

B7. The method of any of paragraphs B1-B6, wherein the communicating further includes providing a location of the self-defense device to the remote location, optionally utilizing a tracking component of the self-defense device.

B8. The method of any of paragraphs B1-B7, wherein the communicating includes communicating in real-time with the remote location.

B9. The method of any of paragraphs B1-B8, wherein the communicating further includes notifying the remote location at least one of:

(i) responsive to the self-defense device detecting that the user is utilizing the self-defense device;

(ii) responsive to authentication of the user by the self-defense device;

(iii) responsive to the recording; and (iv) responsive to the incapacitating.

B10. The method of any of paragraphs B1-B9, wherein the incapacitating includes selectively incapacitating by actuating the offensive component.

B11. The method of any of paragraphs B1-B10, wherein the offensive component includes a plurality of offensive subcomponents, wherein each offensive subcomponent of the plurality of offensive subcomponents is configured to exhibit a corresponding range, and further wherein the incapacitating includes selecting a given offensive subcomponent of the plurality of offensive subcomponents based, at least in part, on a distance from the self-defense device to the aggressor.

B11.1. The method of paragraph B11, wherein the method further includes repeating the selecting to select a different offensive subcomponent of the plurality of offensive subcomponents based, at least in part, on a change in the distance from the self-defense device to the aggressor.

B12. The method of any of paragraphs B1-B11.1, wherein, prior to the incapacitating, the method further includes authenticating the user utilizing a device user-authentication component of the self-defense device to permit actuation of the offensive component. or of an individual offensive subcomponent of a/the plurality of offensive subcomponents, to perform the incapacitating.

B13. The method of any of paragraphs B1-B12, wherein the method further includes receiving a remote disable command from the remote location via the communication component and disabling at least one disabled function of the self-defense device responsive to the receiving.

B14. The method of paragraph B13, wherein the at least one disabled function of the self-defense device includes at least one of:

(i) a status indicator of the self-defense device;

(ii) the offensive component; and (iii) an individual offensive subcomponent of a/the plurality of offensive subcomponents.

B15. The method of any of paragraphs B1-B14, wherein the self-defense device and/or the method includes any suitable structure, function and/or feature of any of the self-defense devices of any of paragraphs A1-A71.

INDUSTRIAL APPLICABILITY

The self-defense devices and methods disclosed herein are applicable to the self-defense and public-defense industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A self-defense device configured to be utilized by a user for protection from an aggressor, the self-defense device comprising:

an offensive component configured to be selectively actuated to incapacitate the aggressor;

a recording component configured to selectively record a local environment that is proximate the self-defense device;

a communication component configured to provide wireless communication between the user and a remote location; and a user detection component configured to detect that the user is utilizing the self-defense device and automatically to enable the recording component and the communication component responsive to detecting that the user is utilizing the self-defense device;

wherein, subsequent to enablement of the recording component and the communication component, the self-defense device is configured to require further authentication of the user prior to permitting actuation of the offensive component.

2. The self-defense device of claim 1, wherein the offensive component includes a plurality of offensive subcomponents, wherein each offensive subcomponent of the plurality of offensive subcomponents is configured to exhibit a corresponding effective range.

3. The self-defense device of claim 2, wherein a range ratio of a first effective range of a first offensive subcomponent of the plurality of offensive subcomponents is within a threshold range ratio multiple of a second effective range of a second offensive subcomponent of the plurality of offensive subcomponents, wherein the threshold range ratio multiple is at least 1.2 and at most 100.

4. The self-defense device of claim 1, wherein the offensive component includes a kinetic offensive component configured to selectively deliver a less lethal kinetic blow to incapacitate the aggressor.

5. The self-defense device of claim 4, wherein the kinetic offensive component includes a projectile offensive component configured to selectively deliver a less lethal projectile to incapacitate the aggressor.

6. The self-defense device of claim 1, wherein the offensive component includes a chemical irritant offensive component configured to selectively deliver a chemical irritant to incapacitate the aggressor.

7. The self-defense device of claim 6, wherein the chemical irritant offensive component is configured to at least one of:

(i) spray the chemical irritant; and (ii) expel a capsule that includes the chemical irritant.

8. The self-defense device of claim 1, wherein the offensive component includes a conducted energy offensive component configured to selectively deliver an electric shock to incapacitate the aggressor.

9. The self-defense device of claim 1, wherein the offensive component includes an optical offensive component configured to emit light and selectively inhibit the aggressor's sight to incapacitate the aggressor.

10. The self-defense device of claim 1, wherein the recording component is configured to selectively record at least one of:

(i) audio from the local environment; and (ii) video of the local environment.

11. The self-defense device of claim 1, wherein the recording component includes a plurality of video cameras, wherein each video camera of the plurality of video cameras is configured to record a corresponding video in a corresponding recording direction, wherein the corresponding recording direction of at least one video camera of the plurality of video cameras differs from the corresponding recording direction of at least one other video camera of the plurality of video cameras.

12. The self-defense device of claim 1, wherein the communication component includes a wireless interface configured to provide the wireless communication.

13. The self-defense device of claim 1, wherein the communication component is configured to provide at least one of:

(i) an output from the recording component to the remote location; and (ii) two-way communication between the user and the remote location.

14. The self-defense device of claim 1, wherein the self-defense device includes a device user-authentication component configured to authenticate the user, wherein the self-defense device is configured to enable at least one restricted-access function of the self-defense device responsive to authentication of the user by the device user-authentication component, wherein the at least one restricted-access function of the self-defense device includes the offensive component, and further wherein the self-defense device is configured to permit actuation of the offensive component only when the device user-authentication component has confirmed that the user is an authorized user of the offensive component.

15. The self-defense device of claim 14, wherein, responsive to authentication of the user, the device user-authentication component is configured to at least one of:

(i) electronically store an activation record that identifies the user;

(ii) transmit an identity of the user to the remote location; and (iii) transmit a unique identifier that identifies the self-defense device to the remote location.

16. The self-defense device of claim 1, wherein the self-defense device further includes a tracking component configured to determine a location of the self-defense device, and further wherein the communication component is configured to provide the location of the self-defense device to the remote location.

17. The self-defense device of claim 1, wherein the self-defense device includes a status indicator configured to provide at least one status of the self-defense device to the user, wherein the at least one status includes at least one of:

(i) a state of charge of the self-defense device;

(ii) a status of communication with the remote location via the communication component;

(iii) a recording status of the recording component;

(iv) a communication monitor status indicative of a presence of a monitoring individual, at the remote location, who is monitoring the wireless communication between the user and the remote location;

(v) an assistance call status that indicates when assistance is enroute to a location of the self-defense device;

(vi) an assistance on-site status that indicates when the assistance is at the location of the self-defense device;

(vii) a readiness of the offensive component to be selectively actuated to incapacitate the aggressor, and (viii) an authentication status of the user by a device user-authentication component of the self-defense device.

18. The self-defense device of claim 1, wherein the recording component includes a plurality of video cameras, wherein each video camera of the plurality of video cameras is configured to record a corresponding video in a corresponding recording direction, wherein the corresponding recording direction of at least one video camera of the plurality of video cameras includes at least one of a forward direction and a rearward direction, and further wherein the corresponding recording direction of at least one other video camera of the plurality of video cameras includes at least one of a leftward direction and a rightward direction.

19. The self-defense device of claim 18, wherein the corresponding recording direction of another video camera of the plurality of video cameras includes a downward direction.

20. The self-defense device of claim 1, wherein the self-defense device includes a device user-authentication component configured to authenticate the user and to provide the further authentication of the user responsive to determining that the user is an authorized user of the offensive component.

21. The self-defense device of claim 1, wherein, responsive to detecting that the user is utilizing the self-defense device, the device user-authentication component is configured to transmit a unique identifier that identifies the self-defense device to the remote location.

22. A method of utilizing a self-defense device for protection from an aggressor, the method comprising:

detecting, utilizing a user detection component of the self-defense device, that a user is utilizing the self-defense device;

responsive to the detecting:

(i) recording, utilizing a recording component of the self-defense device, a local environment that is proximate the self-defense device; and (ii) communicating, utilizing a communication component of the self-defense device, with a remote location;

subsequent to the detecting, authenticating, utilizing a device user-authentication component of the self-defense device, the user, wherein the authenticating includes determining that the user is an authorized user of the offensive component; and incapacitating, utilizing an offensive component of the self-defense device, the aggressor, wherein the self-defense device is configured to require the authenticating prior to permitting actuation of the offensive component.

23. The method of claim 22, wherein the recording component includes a plurality of video cameras, wherein the recording includes utilizing at least one video camera of the plurality of video cameras to record in at least one of a forward direction and a rearward direction, and further wherein the recording includes utilizing at least one other video camera of the plurality of video cameras to record in at least one of a leftward direction and a rightward direction.

24. The method of claim 23, wherein the recording further includes utilizing another video camera of the plurality of video cameras to record in a downward direction.

25. The method of claim 22, wherein, responsive to the detecting, the method further includes transmitting a unique identifier that identifies the self-defense device to the remote location.

* * * * *